United States Patent [19]

Joffre

[11] 4,070,726

[45] Jan. 31, 1978

[54] DEVICES FOR CLEANING, DUSTING, MOPPING OR APPLYING FLUIDS TO FLOORS

[76] Inventor: Robert L. Joffre, 530 Parks Drive, Norton, Ohio 44203

[21] Appl. No.: 698,886

[22] Filed: June 23, 1976

[51] Int. Cl.[2] ..... A47L 13/256; A47L 13/258

[52] U.S. Cl. ..... 15/231; 15/144 A; 15/228

[58] Field of Search ..... 15/149, 201, 202, 209 D, 15/211, 228, 229 A, 229 AC, 229 AP, 229 B, 229 BP, 229 BC, 231-233, 144 A, 147 R, 147 A; 51/370, 371, 391-393

[56] References Cited

U.S. PATENT DOCUMENTS

| | | | |
|---|---|---|---|
| 2,205,535 | 6/1940 | Muckenhirn | 15/231 X |
| 2,560,008 | 7/1951 | Steward | 15/231 |
| 2,864,110 | 12/1958 | Bruger | 15/231 X |
| 2,875,463 | 3/1959 | Minerley | 15/228 X |
| 2,903,730 | 9/1959 | Murphy | 15/233 X |
| 2,987,745 | 6/1961 | Ballinger | 15/229 BP |
| 3,134,129 | 5/1964 | Allen | 15/202 X |
| 3,606,709 | 9/1971 | Countryman | 15/231 X |
| 3,698,030 | 10/1972 | Lockett | 15/231 X |

FOREIGN PATENT DOCUMENTS

| | | | |
|---|---|---|---|
| 423,738 | 4/1911 | France | 15/229 A |
| 54,822 | 5/1911 | Switzerland | 15/228 |
| 510,675 | 8/1939 | United Kingdom | 15/231 |

*Primary Examiner*—Daniel Blum

*Attorney, Agent, or Firm*—Isler and Ornstein

[57] ABSTRACT

Devices are disclosed for cleaning, dusting, mopping or applying fluids to floors. A unique feature is the provision of means which enables a handle to be attached to the device while, at the same time, wedgingly securing portions of a cloth or mop to the device. Another feature involves the provision of extension plates and extension wings for increasing the effective length of the device to accommodate it to the use of cloths, mops, and the like of different lengths. A further feature includes the transposition or inversion of parts of the device to accommodate it to the use of different types of applicator cloths. Still another feature relates to the use of clamping members of unique construction for clamping thereto various types of cleaning cloths and the like.

4 Claims, 26 Drawing Figures

DEVICES FOR CLEANING, DUSTING, MOPPING OR APPLYING FLUIDS TO FLOORS

This invention relates, as indicated, to devices for cleaning, dusting, mopping or applying a fluid to a surface.

A primary object of the invention is to provide a device of the character described, having a base or platform assembly or holder, which is adjustable in length, whereby mop heads, dust cloths, applicator pads and the like of different lengths may be secured thereto, to thereby eliminate the necessity of manufacturing base or platform assemblies of different sizes or lengths to accommodate such different lengths of mop heads, dust cloths, applicator pads and the like.

Another object of the invention is to provide a platform assembly or holder having unique means for retaining and holding such mop heads, dust cloths, applicator pads and the like.

Another object of the invention is to provide a platform assembly or holder of the character described, in which the use of screws, nuts, and other fasteners for securing such mop heads, dust cloths, applicator pads and the like, is virtually eliminated or reduced to a minimum.

A further object of the invention is to provide a device of the character described, comprising a handle and platform assembly or holder, in which the handle may be quickly and easily assembled with the platform assembly or holder, without the aid of extraneous fasteners or fastener means, while retaining a sturdy and strong connection between the handle and platform assembly or holder.

A further object of the invention is to provide a device of the character described, having incorporated therein a clamping member or holder for dust cloths and the like, which member is of channel-shaped cross-section or configuration, having flanges which are resiliently adjustable relatively to each other to accommodate cloths of different thicknesses or multiple layers, without loss of retentivity for such cloths.

A still further object of the invention is to provide a device of the character described, which utilizes a circular rod or the like for wrapping the cloth thereabout, whereby the rod and cloth may be snapped into and retained in the channel-like clamping member.

Other objects and advantages of my invention will be apparent during the course of the following description.

In the accompanying drawings forming a part of this specification, and in which like numerals are employed to designate like parts throughout the same, FIG. 1 is a top plan view of one form of the device of the invention, showing fragmentary portions of a dust mop or cloth attached thereto;

FIG. 13 is a view similar to FIG. 1, but with the extension plates and wings in an inverted position, for adapting the device for use as an applicator for wax, cleaning fluid or the like;

Figure 1:
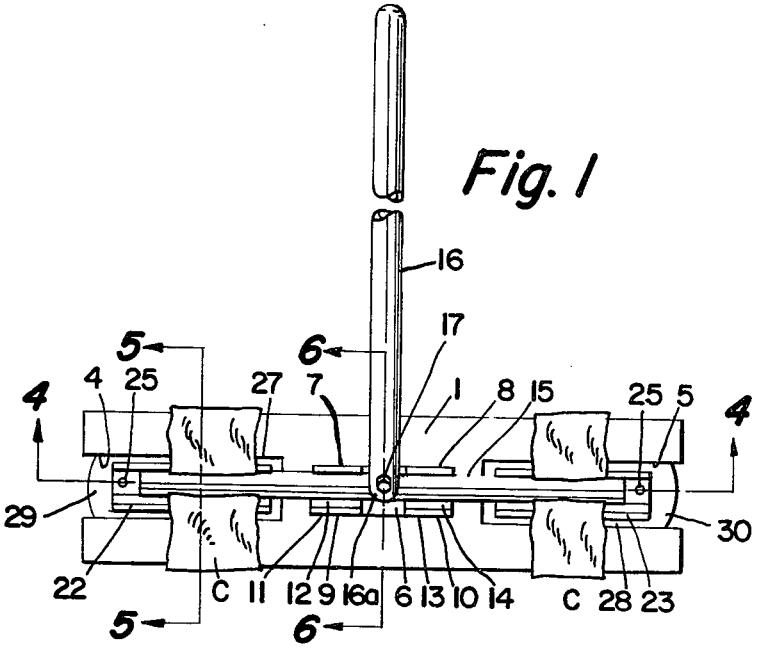

Referring more particularly to FIGS. 1 to 12 inclusive, a device is shown, comprising a base or platform 1, of generally rectangular configuration, having inturned flanges 2 and 3 at its longitudinal edges, which serve a purpose to be presently described.

The base or platform 1 is also provided with longitudinal extending slots 4 and 5, which extend along the axis of the base 1, from the ends of the base to points spaced from the center of the base, and which also serve a purpose to be presently described.

Welded or otherwise secured to the base or platform 1, adjacent the center of the base, is a clamping member, preferably formed of extruded aluminum or like material, and comprising a base portion 6, a pair of coplanar longitudinally-spaced upstanding flanges 7 and 8 at one longitudinal edge of the base portion 6, and a pair of longitudinally-spaced coplanar upstanding flanges 9 and 10 at the other longitudinal edge of the base portion 6, the flanges 9 and 10 lying in a plane which is normally parallel with the plane of the flanges 7 and 8. The flange 9 terminates at its upper end in a flange 11, which extends at an angle of about 45° to the plane of the flange 9, and which, in turn, terminates in a short flange 12 which extends downwardly and at an angle of approximately 90° to the plane of the flange 11. The flange 10 terminates at its upper end in a flange 13, which extends at an angle of about 45° to the plane of the flange 10, and which, in turn, terminates in a short flange 14 which extends downwardly and at an angle of approximately 90° to the plane of the flange 13. The aforesaid clamping member serves a function to be presently described.

For the purpose of clamping or securing a dust mop or cloth C, portions to fragments of which are shown in FIGS. 1, 2, 3 and 5, to the aforesaid clamping member, a tubular member 15 is provided, to the center of which a handle 16 is secured, as by means of a bolt 17 and nut 18.

The handle 16 is provided at its lower end with spaced portions 16*a* and 16*b*, which span the tubular member 15, and which are provided respectively with holes 19 and 20, through which the bolt 17 extends.

By connecting the handle 16 to the tubular member 15 in the aforesaid member, the handle may be used to cause the tubular member to rotate or rock about the axis of the tubular member, and may also be used to cause the handle to rotate or rock about the axis of the bolt 17. The handle 16 is thus, in effect, joined to the tubular member 15, to create a universal joint connection.

Figure 5:
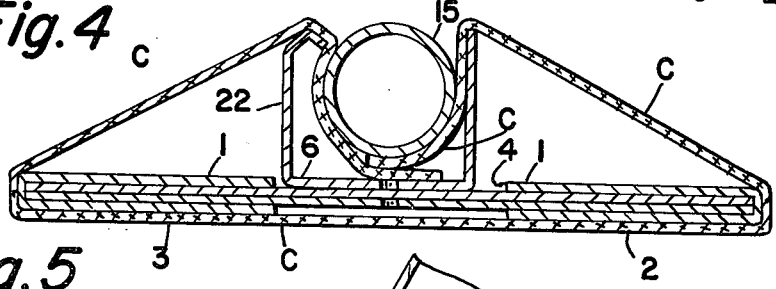
FIG. 5 is a cross-sectional view, at full-size scale, taken on the line 5—5 of FIG. 1.
Figure 6:
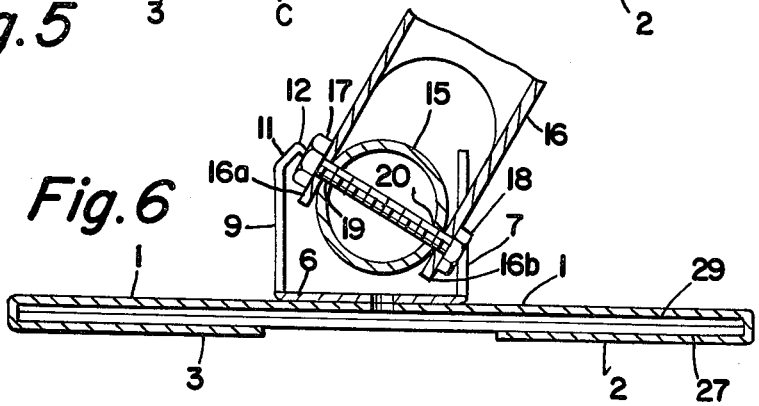
FIG. 6 is a cross-sectional view, at full-size scale, taken on the line 6—6 of FIG. 1.

When it is desired to clamp a dust mop or cloth C to the base or platform 1, and the mop or cloth is of a length approximately the same as that of the base or platform 1, the marginal portions of the mop or cloth are placed within the spaces between the flanges 12 and 7 and the flanges 14 and 8, and are wedged within the clamping member, by snapping the tubular member 15 into the clamping member, in the manner indicated in FIG. 5.

As seen in FIGS. 1, 2, 3, 4 and 5, the mop or cloth C is also clamped by the tubular member 15 to clamping members 22 and 23, which are in longitudinal alignment with and similar in construction to the clamping member 6, 7, 8, 9, 10, 11, 12, 13 and 14, which has been described.

Figure 7:
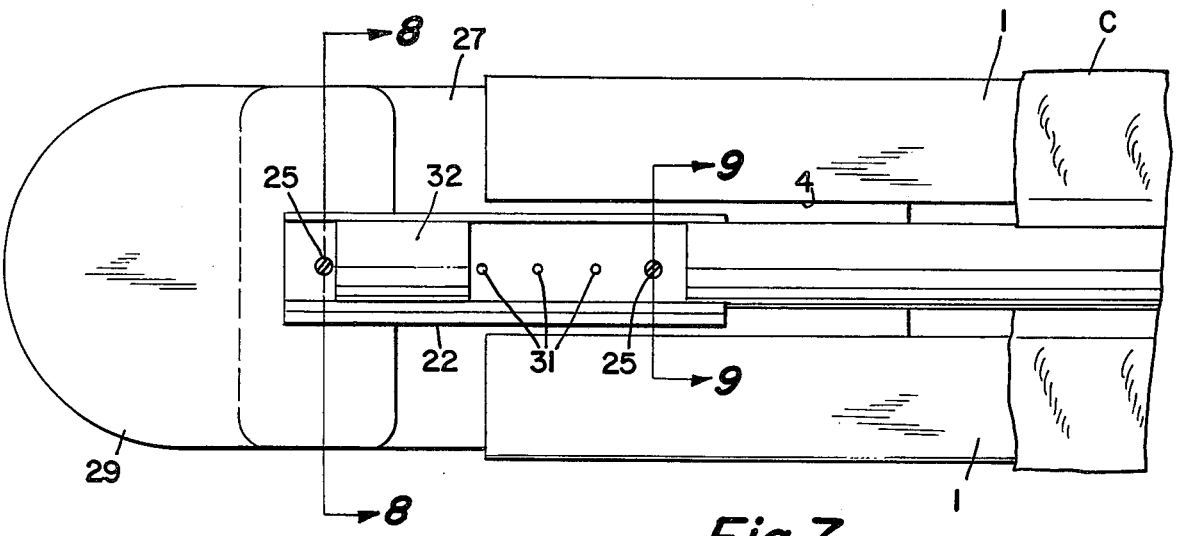
FIG. 7 is a fragmentary top plan view of the left end of the device of FIG. 1, on an enlarged scale, but showing the extension plate and extension wing in an extended position.
Figure 8:
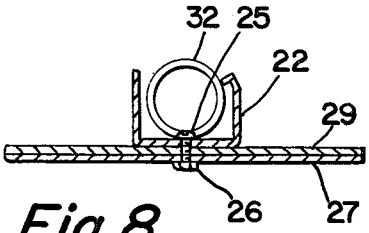
FIG. 8 is a cross-sectional view, taken on the line 8—8 of FIG. 7.
Figure 9:
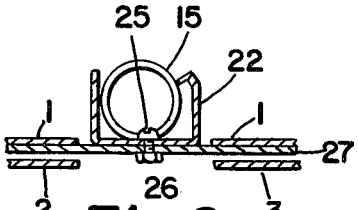
FIG. 9 is a fragmentary cross-sectional view, taken on the line 9—9 of FIG. 7.

The clamping member 22 is secured, as by screws 25 and nuts 26, to an extension or extension plate 27, which, as best seen in FIGS. 7, 8 and 9, is mounted for slidable movement in tracks formed between and by the base or platform 1 and the inturned flanges 2 and 3.

Figure 3:
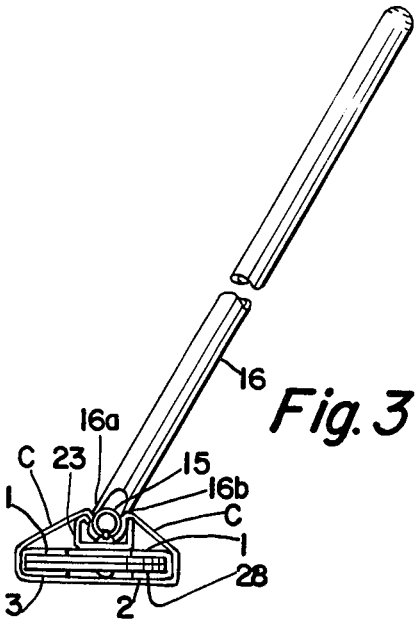
FIG. 3 is an end elevational view of the device shown in FIGS. 1 and 2, as viewed from the right end of FIG. 2.
Figure 4:
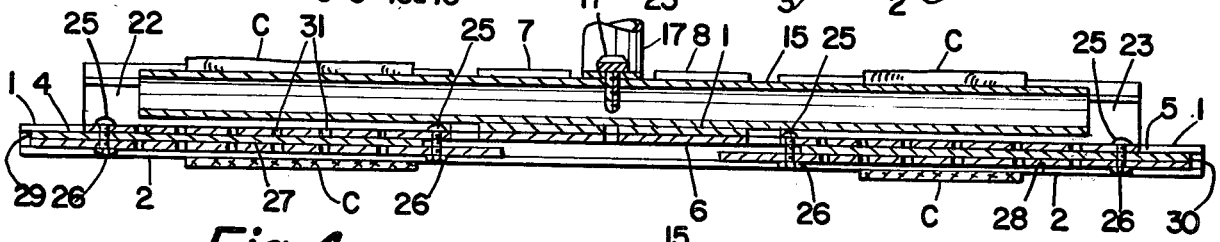
FIG. 4 is a cross-sectional view, on a somewhat enlarged scale, taken on the line 4—4 of FIG. 1.

The clamping member 23 is similarly secured, as by screws 25 and nuts 26, to an extension or extension plate 28, which, as best seen in FIGS. 1, 3 and 4, is mounted for slidable movement in tracks formed by and between the base 1 and the inturned flanges 2 and 3.

The extensions or extension plates 27 and 28 are in the position shown in FIGS. 1 and 4 when the device is used for securing thereto a dust mop or cloth of a length no greater than the overall length of the base or platform 1.

It may be noted, at this point, that the tubular member 15 is rotatable about its axis, even when the thickness of the cloth C varies to some extent. If, however, the thickness of the dust cloth C varies to a degree such that the tubular member 15 would fit too loosely or too tightly in the spaces within the clamping members, such as to interfere with the rotation of the tubular member 15, this may be compensated for by bending the flanges of the clamping members toward or away from each other, such bending being possible by reason of the resiliency of such flanges.

When a dust mop or cloth of a length in excess of the overall length of the base or platform 1 is to be secured to the device, the extensions or extension plates 27 and 28 are slid away from the base or platform 1 to a position shown, for example, in FIGS. 7, 8 and 9.

For the purpose of providing additional length for the device, that is to say, length in excess of the length provided by the extensions or extension plates 27 and 28 when fully extended, extension wings 29 and 30 are provided.

The extension wing 29, as seen in FIGS. 7 and 8, is superimposed on the extension plate 27, and is secured to the latter, as by the screw 25 and nut 26. At the opposite end of the device, the extension wing 30 is superimposed on the extension plate 28, and is secured to the latter by a screw and nut in the same manner that the wing 29 is secured to the extension plate 27.

As seen in FIGS. 4 and 7, the clamping member 22 is provided with a series of uniformly spaced holes 31, and the extension plate 27 is provided with a series of holes similarly spaced, which are in alignment with the holes 31. This permits the extension wing 29 to be adjusted longitudinally relatively to the extension plate 27 by aligning the hole in the wing 29 through which the screw 25 passes with one or another of the holes 31 in the clamping member 22 and extension plate 27. In a similar manner, the extension wing 30 at the opposite end of the device may be adjusted longitudinally in relation to the extension plate 28.

As further indicated in FIGS. 7, 8 and 9, where the length of the cloth C is substantially in excess of the length of the platform or base 1, a short auxiliary tube 32, of the same diameter as the tube 15, may be used to clamp the end portion of the cloth to the clamping member 22, and, at the opposite end of the device, a similar auxiliary tube (not shown) may be used to clamp the other end portion of the cloth to the clamping member 23.

Figure 10:
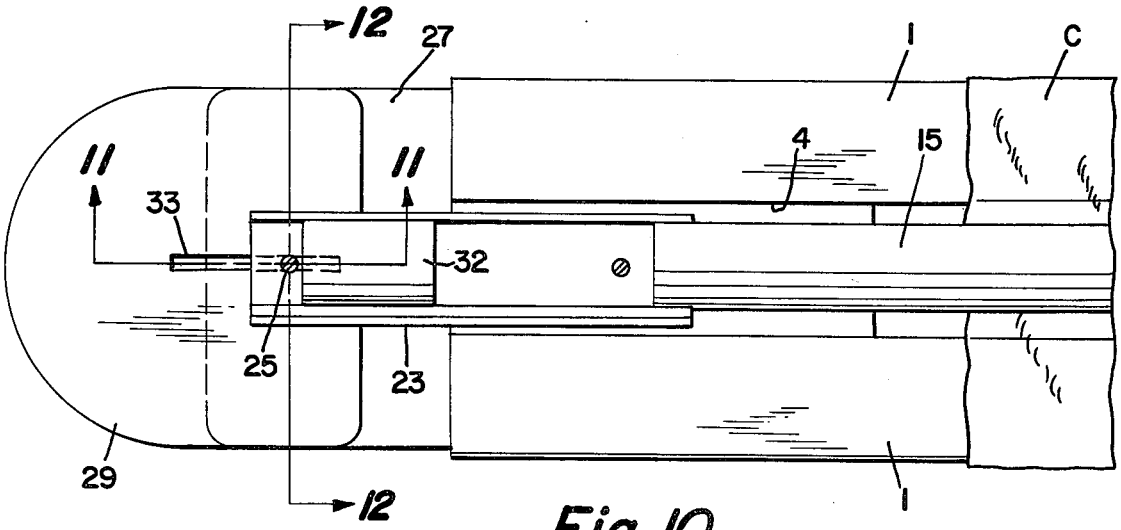
FIG. 10 is a view similar to FIG. 7, but of a modification of the device.
Figure 11:
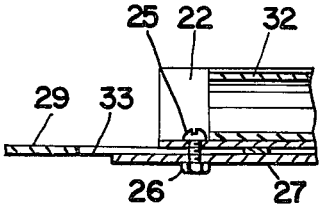
FIG. 11 is a fragmentary cross-sectional view, taken on the line 11—11 of FIG. 10.
Figure 12:
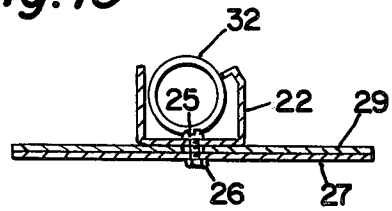
FIG. 12 is a cross-sectional view, taken on the line 12—12 of FIG. 10.
Figure 13:
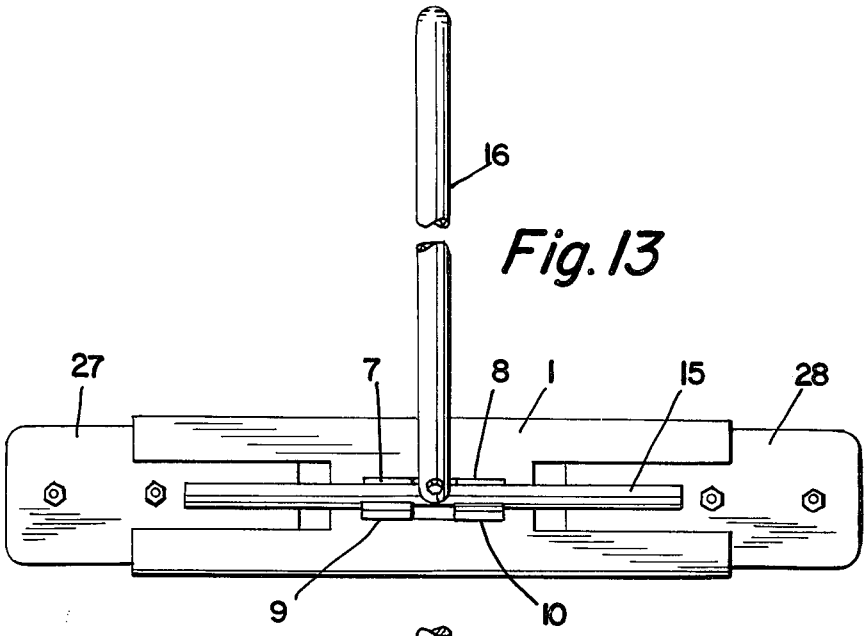
Figure 14:
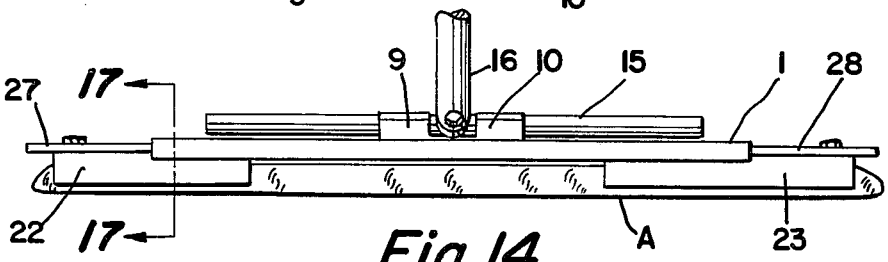
FIG. 14 is a view similar to FIG. 2, but of the device of FIG. 13.
Figure 15:
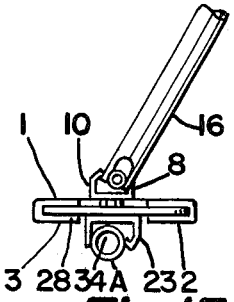
FIG. 15 is a view similar to FIG. 3, but of the device of FIG. 13.
Figure 16:
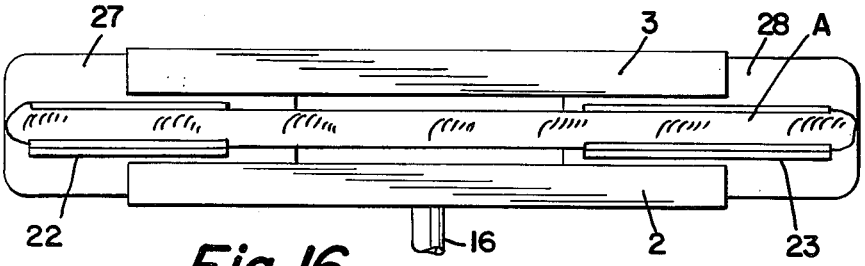
FIG. 16 is a bottom plan view of the device of FIG. 13.

In FIGS. 10, 11 and 12, a modification in the method of adjusting the extension wing 29 longitudinally in relation to the extension plate 27 is shown. In this modification, the extension wing 29 is provided with an elongated slot 33, through which the screw 25 passes. When the screw 25 is loosened, the wing 29 may be adjusted to any desired position relatively to the plate 27, and the screw then tightened. In a similar manner, the extension wing 30 at the opposite end of the device may be adjusted longitudinally in relation to the extension plate 28.

In FIGS. 13 to 17 inclusive, the device of FIGS. 1 to 12 inclusive, is shown as adapted for use as a platform or holder for an applicator or applicator pad A, by means of which a fluid, such as a cleaning fluid or liquid wax, may be applied to or spread over a surface.

For this purpose, the extension plates 27 and 28 are inverted, in relation to the base or platform 1, so as to position the clamping members 22 and 23 in a depending relation to the base or platform 1, as best seen in FIGS. 14, 15, 16 and 17.

Figure 17:
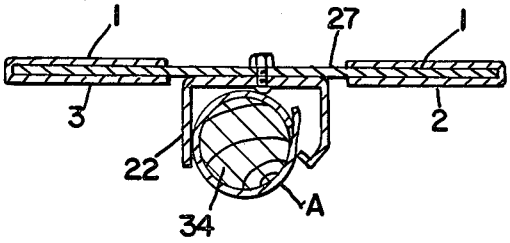
FIG. 17 is a cross-sectional view, on slightly enlarged scale, taken on the line 17—17 of FIG. 14.
Figure 18:
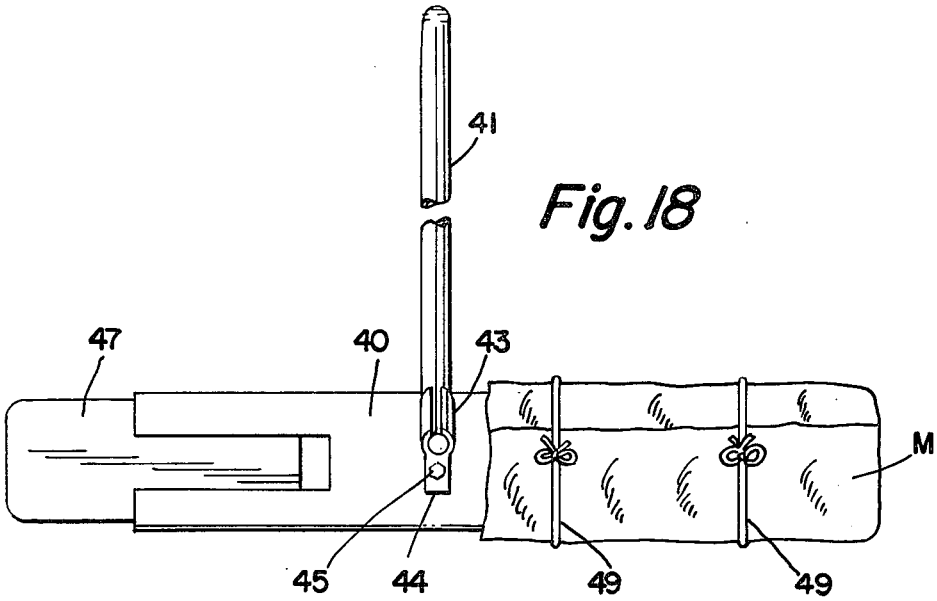
FIG. 18 is a view similar to FIG. 1, but of a modification of the device.
Figure 19:
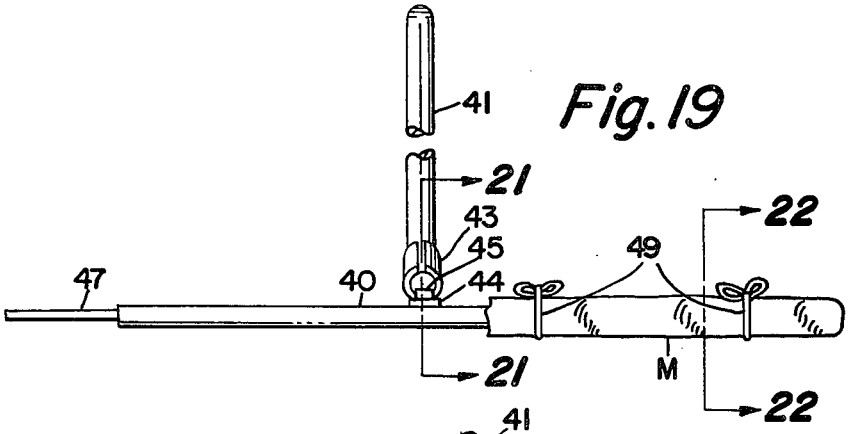
FIG. 19 is a front elevational view of the device of FIG. 18.
Figure 20:
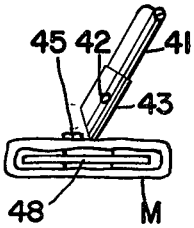
FIG. 20 is an end elevational view of the device of FIG. 19 as viewed from the right end of FIG. 19.
Figure 21:
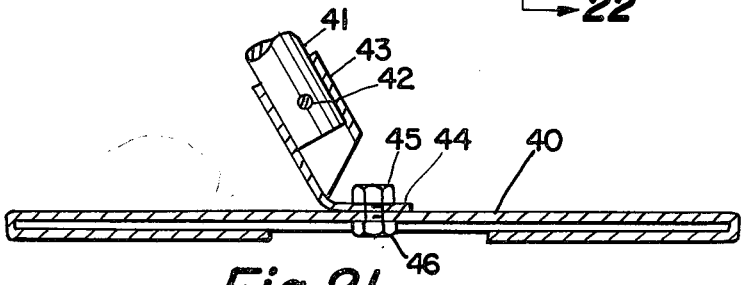
FIG. 21 is a fragmentary cross-sectional view, taken on the line 21—21 of FIG. 19.
Figure 22:
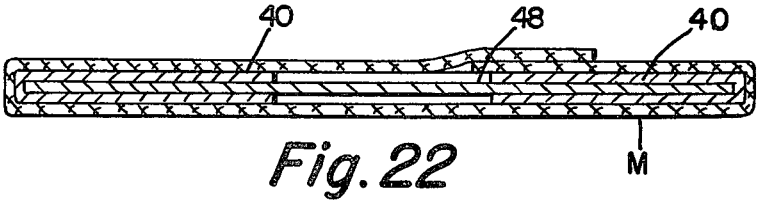
FIG. 22 is a cross-sectional view, taken on the line 22—22 of FIG. 19.
Figure 23:
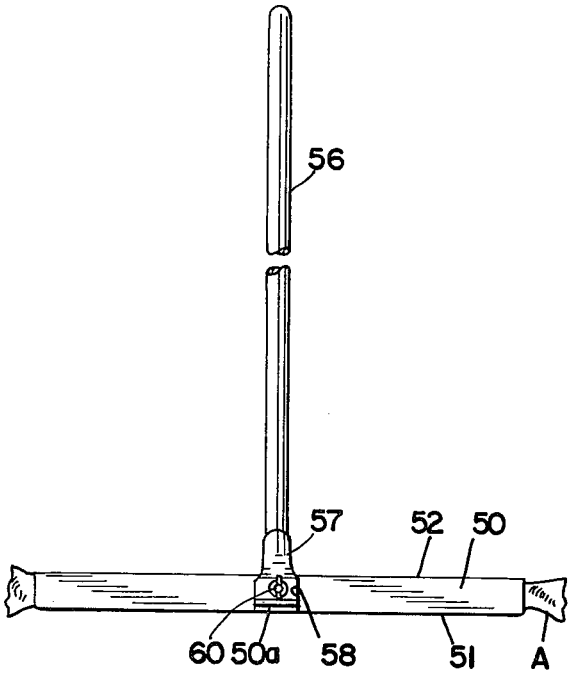
FIG. 23 is a view similar to FIG. 1, but of another modification of the device.

An applicator or applicator pad A is then wound around or about an elongated element or rod 34 (FIG. 17), which may be either a solid round rod of wood or the like, or a tubular member, similar to the tubular member 15, and the pad and element 34 then snapped into the clamping members 22 and 23 in the manner shown in FIG. 17.

It may be noted, however, that in using the device in the aforesaid manner or for the aforesaid purposes, it is preferred that the platform or base 1 and the clamping members 22 and 23 be maintained in substantial parallelism with the floor. For this purpose, the handle 16, instead of being pivotally connected to the base or platform 1, is rigidly connected to the base or platform 1, in a manner which will be described in connection with the modifications shown in FIGS. 18 to 24 inclusive.

In FIGS. 18 to 22 inclusive, a modification is shown, which is adapted more particularly for use with a mopping cloth or pad M.

For this purpose, the device comprises a base or platform 40 which is similar in construction or configuration to the platform or base 1 of that form of the device shown in FIGS. 1 to 17 inclusive.

In this case, however, a handle 41 is provided which is secured, as by a rivet or pin 42, to a ferrule or collar 43, having a flange 44. The flange 44 is rigidly secured, as by a bolt 45 and nut 46, to the center of the base 40.

The device is provided with flat extension plates 47 and 48, which are slidably connected to the base or platform 40 in the same manner that the extension plates 27 and 28 are connected to the base or platform 1 in FIGS. 1 to 17 inclusive, so that the plates 47 and 48 may be adjusted to any desired position longtiduinally of the base or platform 40, depending on the length of the cloth or pad M.

In this form of the invention, the clamping members which have been described in connection with the previously described forms of the device, and the extension wings, need not be used.

Figure 2:
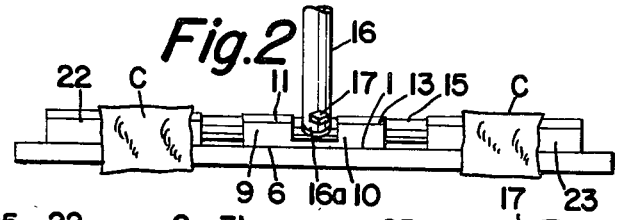
FIG. 2 shows a front elevational view of the form of the device shown in FIG. 1.

With the extension plates in extended position, as in FIGS. 1 and 2, the mopping cloth M may be wrapped about the platform or base 40 and the extension plates, and secured thereto by means of strings 49 or the like.

Instead of using a mopping cloth M of the character described, the device of FIGS. 18–22 may be used for the attachment thereto of a mop-like member 50-51-52 which is shown in my U.S. Pat. No. 3,932,043.

In FIGS. 23–26 inclusive, another modification of the device is shown, in which an elongated clamping member is employed.

The clamping member comprises a base portion 50, a downwardly extending flange 51, adjacent one longitudinal edge of the portion 50, and a downwardly extending flange 52 at the other longitudinal edge of the portion 50, the flange 52 being substantially parallel with the flange 51.

The flange 52 terminates at its lower end in a flange 53, which extends at an angle of about 45° to the plane of the flange 52, and on upturned portion 54.

Figure 26:
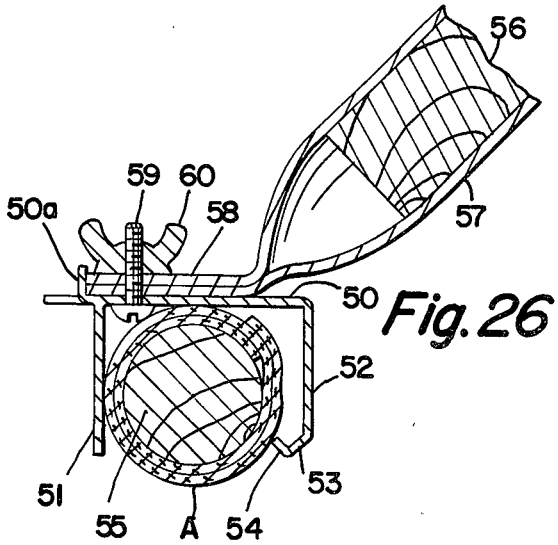
FIG. 26 is a fragmentary cross-sectional view, at full-size scale, taken on the line 26—26 of FIG. 24.
Figure 24:
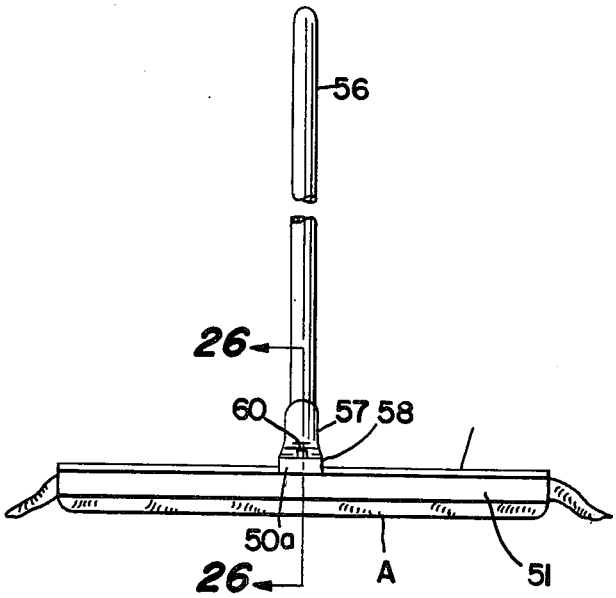
FIG. 24 is a front elevational view of the device of FIG. 23.
Figure 25:
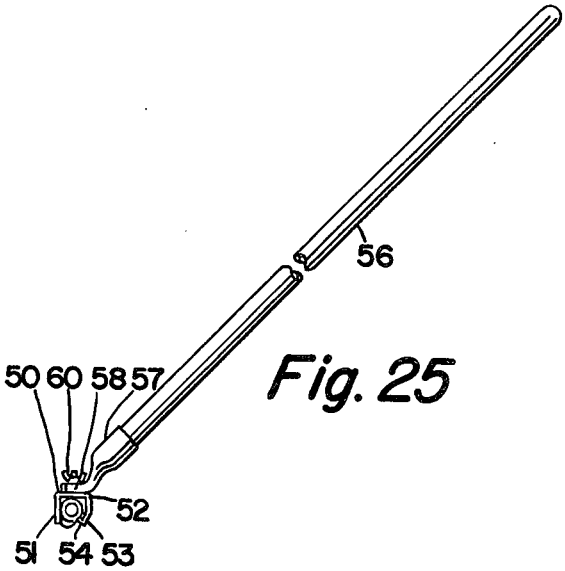
FIG. 25 is an end elevational view of the device of FIG. 24, as viewed from the right end of FIG. 24.

An applicator or applicator pad A is then wound around or about an elongated element or rod 55 (FIG. 26), which may be either a solid round rod of wood or the like or a tubular member, similar to the tubular member 15, and the pad and element 59 then snapped into the clamping member, as best seen in FIG. 26.

The aforesaid device is provided with a handle 56, which is secured to a ferrule or socket element 57, having a flattened lower end 58, which is secured, as by a screw 59 and wing nut 60, to the base portion 50 of the clamping member.

To prevent the socket element 57 from rotating about the screw 59 during use of the device, a short flange or detent **50*a* is struck up from the base portion 50, and engages the forward end of the flattened lower end 58 of the socket element 57**.

It is to be understood that the forms of my invention herewith shown and described, are to be taken as a preferred examples of the same, and that various changes may be made in the shape, size and arrangement of parts thereof, without departing from the spirit of the invention or the scope of the subjoined claims.

Having thus described my invention, I claim:

1. A device of the character described comprising a substantially flat base of generally rectangular configuration, having a clamping member secured thereto, said clamping member being of channel-shaped cross-section having spaced upstanding flanges which are movable relatively to each other, a wiping member comprising a cloth having marginal portions disposed in the space between said flanges, means comprising an elongated rod of round cross-section within said clamped member which wedgingly secures said marginal portions of said wiping member to said flanges, and a handle secured to said rod by a transverse pivotal connection, said handle being movable to cause said rod to rotate about its central longitudinal axis to provide a universal joint for the device.

2. A device of the character described, comprising a base having a clamping member secured thereto, said clamping member being of channel-shaped cross section, a handle, a wiping member comprising a cloth having marginal portions, means for wedgingly securing said marginal portions of said cloth to said clamping member, said means comprising an elongated rod of round cross section movable about its central longitudinal axis, said handle being secured to said rod by a transverse pivotal connection, and extension plates slidable in said base and movable relatively to said base and to positions beyond the ends of said base whereby to increase the effective length of said base.

3. A device, as defined in claim 2, having extension wings secured to said extension plates and movable relatively to said extension plates for additionally increasing the effective length of said base.

4. A device of the character described, comprising a base, a handle secured to said base, extension plates slidable in said base and movable relatively to said base and to positions beyond the ends of said base for increasing the effective length of said base, a clamping member secured to each of said extension plates and depending from said plates, a rod of round cross-section, and a wiping member wrapped about said rod, said rod and wiping member being wedgingly secured within said clamping members.

* * * * *